US008210074B2

(12) United States Patent
Wang

(10) Patent No.: US 8,210,074 B2
(45) Date of Patent: Jul. 3, 2012

(54) DISMANTLING DEVICE

(75) Inventor: Boyong Wang, Shaoxing (CN)

(73) Assignee: Shangyu Huanzhou Tools Co., Ltd., Zhejiang (CN)

( * ) Notice: Subject to any disclaimer, the term of this patent is extended or adjusted under 35 U.S.C. 154(b) by 338 days.

(21) Appl. No.: 12/698,625

(22) Filed: Feb. 2, 2010

(65) Prior Publication Data

US 2011/0146458 A1 Jun. 23, 2011

(30) Foreign Application Priority Data

Dec. 17, 2009 (CN) ..... 2009 2 0202491 U

(51) Int. Cl.
*B25B 13/46* (2006.01)

(52) U.S. Cl. ..... 81/63.2; 81/63.1

(58) Field of Classification Search ..... 81/58.4, 81/63.1, 63.2, 63, 3.41
See application file for complete search history.

(56) References Cited

U.S. PATENT DOCUMENTS

| | | | | |
|---|---|---|---|---|
| 1,619,043 | A * | 3/1927 | Scheiwer | 81/63.1 |
| 3,222,943 | A * | 12/1965 | McDonald | 74/157 |
| 4,612,830 | A * | 9/1986 | Yang | 81/63.2 |
| 4,811,636 | A * | 3/1989 | Okura | 81/63.2 |
| 6,601,477 | B2 * | 8/2003 | Huang | 81/63.2 |
| 6,854,363 | B2 * | 2/2005 | Ping | 81/63.1 |
| 7,066,056 | B1 * | 6/2006 | Hsieh | 81/63.2 |
| 7,107,877 | B2 * | 9/2006 | Lee | 81/63 |
| 7,770,495 | B1 * | 8/2010 | Huang | 81/63.1 |
| 7,926,391 | B2 * | 4/2011 | Hu | 81/63.1 |
| 2003/0126958 | A1 * | 7/2003 | Ping | 81/63.1 |
| 2004/0159192 | A1 * | 8/2004 | Ping | 81/63.1 |
| 2009/0193944 | A1 * | 8/2009 | Yang | 81/465 |

FOREIGN PATENT DOCUMENTS

| | | |
|---|---|---|
| CN | 2283550 Y | 6/1998 |
| CN | 101386160 A | 3/2009 |

* cited by examiner

*Primary Examiner* — David B Thomas
(74) *Attorney, Agent, or Firm* — Hamre, Schumann, Mueller & Larson, P.C.

(57) ABSTRACT

A dismantling device comprises a tubular body and a tubular dismantling head, with a front end of the body inserted into a back end of the dismantling head, and a front end of the dismantling head provided with a dismantling structure to be engaged with a work piece. An inner wall of the back end of the dismantling head is provided with an inner toothed ring encircled by a number of teeth. An outside of the body is encircled by a hand wheel. The hand wheel is provided with a meshing block, revolving together with the hand wheel by a drive of the hand wheel. A link mechanism is provided inside a window, driving the meshing block to rotate a certain angle and making a front end of the meshing block to engage with the inner toothed ring at the dismantling head when the hand wheel is rotating.

10 Claims, 2 Drawing Sheets

DISMANTLING DEVICE

TECHNICAL FIELD

This invention relates to a mechanical technical field, in particular to a dismantling device.

BACKGROUND ART

The ratchet screwdriver is widely used in daily life, but the ratchet screwdriver using prior art is unreasonable in design of the control structure, resulting in comparatively unstable transmission, inconvenient control, uneasy operation and bad structural strength, etc.

In order to improve the ratchet screwdriver, people have made research for a long time and put forward various solutions. For example, China Patent Document discloses a control structure of ratchet screwdriver [Application No.: 96234573.3], comprising a sleeve, with its interior provided with an actuating rod and its circumference provided with a through slot, wherein the actuating rod is provided with a gear, an actuating block slidably fitted inside the through slot and having two opposite ratchets for meshing with the gear, an ejector block for pushing the actuating block move back and forth along the through slot, a spring for pressing downwards two ratchets to mesh with the gear so as to control forward and reverse movements of the gear and actuating rod when the two ratchets are respectively meshed with the gear and so as to secure the gear and actuating rod and thus preventing them from forward and reverse movements when the two ratchets are meshing with the gear synchronously. Some people have invented a ratchet screwdriver and its ratchet apparatus [Application No.: 200810121667.1], comprising a ratchet seat, a outer retainer ring, a pawl seat and two pawls, wherein the ratchet seat wraps the pawl seat, the inner ring of the ratchet seat is provided with a ratchet meshing with the pawl, the side walls of the two sides of the pawl are respectively provided with hinge slots, the two pawls are respectively hinged in the hinge slots, and the pawl set is provided with a return spring, making pawl stretched towards two sides and keeping the pawl meshing with the ratchet; the outer retainer ring wraps the outside faces of the two pawls, the inner ring of the outer retainer ring is provided with an arc notch, the outer ends of the two pawls are inside the arc notch, and the arc notch has two convex edges, one of which press inwards one pawl to make it stop meshing with the ratchet when it is rotated towards one side. The above-mentioned solutions have solved some issues existing in the prior art to a certain degree, but technical issues still exist, such as comparatively complicated structure, inconvenient operation and low strength.

CONTENTS OF THE INVENTION

An object of this invention is to provide a dismantling device with reasonable design, simple structure, high strength and easy way to operate for solving the above-mentioned issues.

In order to achieve the above-mentioned object, the invention has adopted the following technical scheme: A dismantling device, comprising a tubular body and a tubular dismantling head, with the front end of the body inserted into the back end of dismantling head, and the front end of dismantling head provided with a dismantling structure engaged with work piece, characterized in that: the inner wall of the back end of the said dismantling head is provided with an inner toothed ring encircled by a number of teeth, the outside of the said body is encircled by a hand wheel, the hand wheel is provided with a meshing block, revolving together with the hand wheel by the drive of hand wheel, a window is at the side of the body, a link mechanism is provided inside the window, driving the meshing block rotate for a certain angle and making the front end of the meshing block engage with the inner toothed ring at the dismantling head when the hand wheel is rotating, and the said dismantling head can rotate synchronously with the hand wheel when the meshing block is engaged with the inner toothed ring and keeps rotating the hand wheel.

When the hand wheel is rotating, the meshing block revolves by the drive of the link mechanism, consequently making the front end of the meshing block mesh with the inner toothed ring. At this time, the hand wheel is made to keep rotating and can drive the meshing block rotate, consequently transferring the torsion from the hand wheel to the dismantling head. Since the dismantling head can be connected to the work piece to be dismantled, it can drive the work piece rotate and consequently dismantle or install the work piece. Depending on the demand, the structure to be dismantled can be equilateral hexagonal hole, equilateral octagonal hole, slotted head or cross head, etc. When the hand wheel is rotating reversely, the working process is the same.

In the above-mentioned dismantling device, the said link mechanism comprises a pillow like body and two springs, the said pillow like body is inside the window and its two sides respectively bear down upon the two sides of the meshing block, the said two springs respectively are at the two sides of the pillow like body, and one end of any of the springs is connected to the body and the other end of any of the springs is connected to the end part of the pillow like body.

When the hand wheel stops rotating, the pillow like body and the meshing block are in balanced state, and the two springs are compressed to the same degree. When the hand wheel starts rotating towards one direction, the pillow like body and the meshing block are not balanced any more, and under the action of the springs, the pillow like body gradually inclines with its one side as the pivot point, and consequently driving the meshing block incline also with this side as the pivot point, finally realizing rotation. At this time, the front end of the meshing block can mesh with the inner toothed ring. When the hand wheel is rotating reversely, the pillow like body gradually inclines with its other side as the pivot point, and consequently driving the meshing block incline also with this side as the pivot point finally realizing rotation. At this time, the front end of the meshing block also can be meshed with the inner toothed ring. After the front end of the meshing block has meshed with the inner toothed ring, the hand wheel can drive the dismantling head rotate.

Apparently, in this application, the rotation direction and the pivot point of rotation of the pillow like body and meshing block change depending on the rotation direction of the hand wheel.

In the above-mentioned dismantling device, the said meshing block is provided with a tile like part, which is on the outside face of the window, and a meshing part, extending forwards to the interior of the dismantling head, the said tile like part pumps up outwards, the outside face of the tile like part is provided with a convex block, and the inner wall of the hand wheel is provided with a holding hole for holding the said convex block.

Due to the convex block and holding hole, the hand wheel can drive the meshing block rotate after the front end of the meshing block has meshed with the inner toothed ring and the hand wheel is made to keep rotating. Since the meshing block is provided with the tile like part pumping up outwards, the rotation can be easily realized if the force applied on one side is comparatively large.

In the above-mentioned dismantling device, the said pillow like body is depressed in the middle part and its two sides on the outside face are respective provided with first contact bevels, the two sides on the inside face of the said tile like part are respectively provided with the second contact bevels, and the said first contact bevels and the second contact bevels are in pair and attached to each other closely.

Due to the first contact bevel and second contact bevel, the pillow like body and the tile like part are coordinated more closely and stably, not causing slippage.

In the above-mentioned dismantling device, the two sides of the inside face of the said tile like part are respectively provided with third inclined planes inclining inwards, and the said two springs respectively act upon the two third inclined planes. Since the third inclined planes can produce inclined and inward acting force against the springs, the springs will not slip from the tile like part.

In the above-mentioned dismantling device, the said body has two spring holes, and one of the said springs is inside one of the spring holes. Since the spring is mounted inside the spring hole, with one end inside the hole while the other end outside the hole, therefore, the spring and the pillow like body match with each other stably, not causing slippage.

In the above-mentioned dismantling device, a positioning structure is provided between the said body and hand wheel, including a compression spring and a steel ball. The said compression spring is in the compression spring hole on the outer wall of the body, the inner wall of the said hand wheel has a notch, and the said compression spring presses the steel ball inside the notch. The positioning structure prevents the slippage between the body and the hand wheel.

In the above-mentioned dismantling device, the said body is fixed to the dismantling head through bolt.

In the above-mentioned dismantling device, the outside face of the said hand wheel (3) is provided with a concave-convex friction increasing structure, which is more convenient for an operator to use.

In the above-mentioned dismantling device, the outside face of the back end of the said body is provided with a number of convex bars extending axially.

Compared with the prior art, this dismantling device has the following advantages: 1. reasonable design, simple and compact structure, high strength, easy to operate. 2. Stable meshing part, high operation stability, no lock caused and long lifetime.

Figure 1:
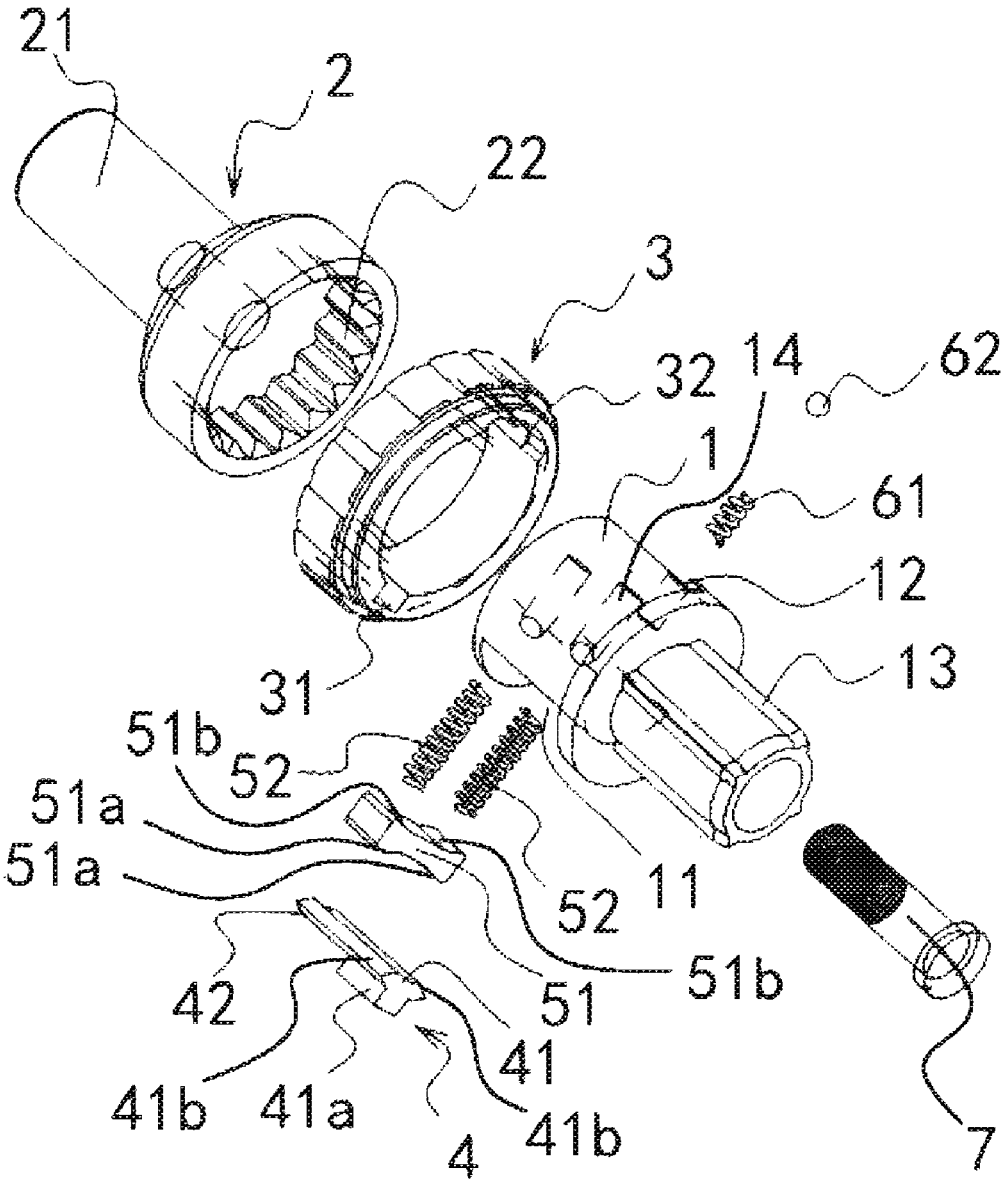
FIG. 1 is the exploded view of this invention.

In figures, body 1, widow 11, compression spring hole 12, convex bar 13, spring hole 14, dismantling head 2, dismantling structure 21, inner toothed ring 22, hand wheel 3, holding hole 31, notch 32, meshing block 4, tile like part 41, convex block 41*a*, second contact bevel 41*b*, meshing part 42, pillow like body 51, first contact bevel 51*a*, third inclined plane 51*b*, spring 52, compression spring 61, steel ball 62, bolt 7.

MODE OF CARRYING OUT THE INVENTION

Figure 2:
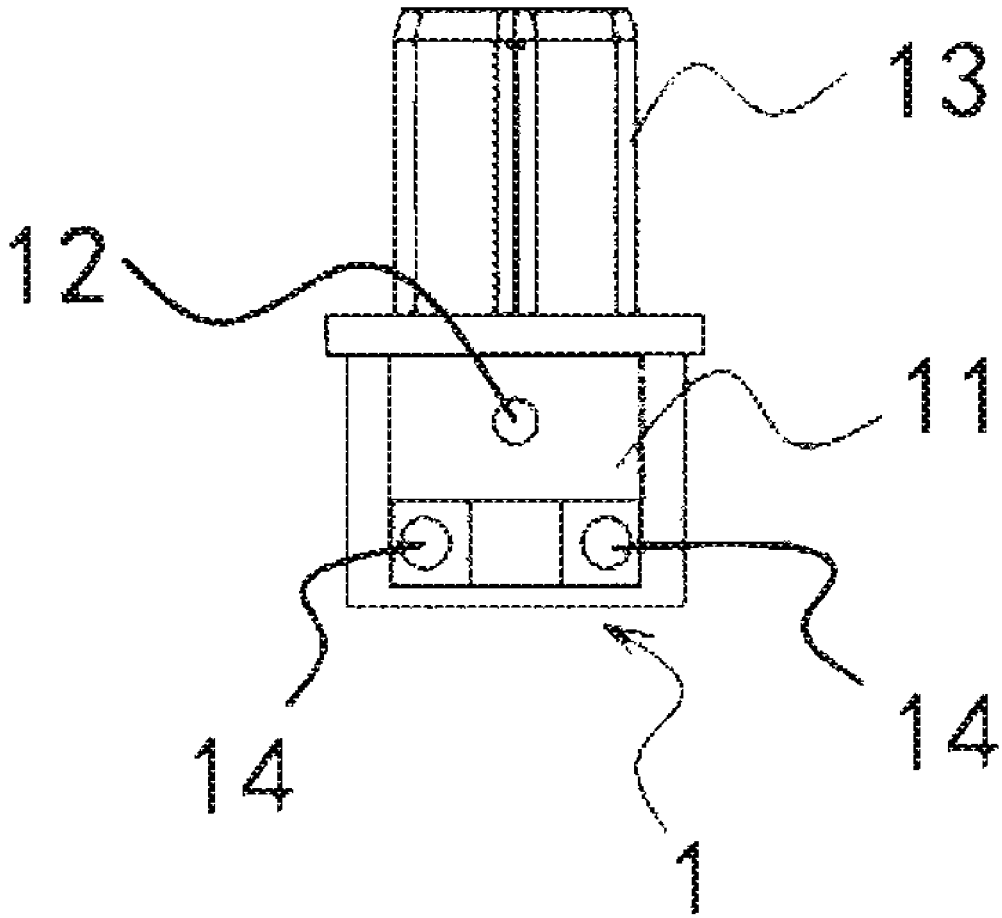
FIG. 2 is the structure diagram of the body of this invention

As shown in FIGS. 1 and 2, this dismantling device comprises a body 1, a dismantling head 2, a hand wheel 3, a link mechanism and other parts. The body 1, dismantling head 2 and hand wheel 3 are all tubular, with the front end of the body 1 inserted in the back end of the dismantling head 2, and the front end of the dismantling head 2 provided with a dismantling structure 21, fitting to the work piece. The body 1 is fixed to the dismantling head 2 through bolt, and the hand wheel 3 wraps the body 1. Depending on the demand, the structure to be dismantled can be equilateral hexagon hole, equilateral octagonal hole, slotted head or cross head, etc. The outside face of the hand wheel 3 is provided with a concave-convex friction increasing structure. Since the dismantling head can be connected to the work piece to be dismantled, it can drive the work piece rotate and consequently dismantle or install the work piece.

The inner wall of the back end of the said dismantling head 2 is provided with an inner toothed ring 22 encircled by a number of teeth. The hand wheel 3 is provided with a meshing block 4 , revolving together with the hand wheel 3 by the drive of hand wheel 3. A window 11 is at the side of the body 1, a link mechanism is provided inside the window 11, driving the meshing block 4 rotate for a certain angle and making the front end of the meshing block 4 engage with the inner toothed ring at the dismantling head 2 when the hand wheel 3 is rotating, and the said dismantling head 2 can rotate synchronously with the hand wheel 3 when the meshing block 4 has engaged with the inner toothed ring 22 and keeps rotating the hand wheel 3.

The outside face of the back end of the body 1 is provided with a number of convex bars 13 extending axially. A positioning structure is provided between the body 1 and hand wheel 3, including a compression spring 61 and a steel ball 62. The compression spring 61 is in the compression spring hole 12 on the outer wall of the body, the inner wall of the said hand wheel 3 has a notch 32, and the compression spring 61 presses the steel ball 62 inside the notch 32.

More specifically, the link mechanism includes a pillow like body 51 and two springs 52. The pillow like body 51 is inside the window 11 and its two sides respectively bear down upon the two sides of the meshing block 4. The two springs 52 are respectively at the two sides of the pillow like body 51, and one end of any of the springs 52 is connected to the body 1 and the other end of any of the springs 51 is connected to the end part of the pillow like body 51. In order to better mount the spring 52 and improve the operation stability, the body 1 has two spring holes 14, one of the said spring 52 is inside one of the two spring holes 14. The two sides of the inside face of the said tile like part 41 are respectively provide with third inclined planes 51*b* inclining towards, the two springs 52 respectively act upon the two third inclined planes 51*b*.

The said meshing block 4 is provided with a tile like part 41, being on the outside face of the window 11, and a meshing part 42, which is extending forwards to the interior of the dismantling head 2. The tile like part 41 pumps up outwards, the outside face of the tile like part 41 is provided with a convex block 41*a*, and the inner wall of the hand wheel 3 is provided with a holding hole 31 for holding the convex block 41*a*. The pillow like body 51 is depressed in the middle part and its two sides on the outside face are respectively provided with the first contact bevels 51*a*, and the two sides on the inside face of the tile like part 41 are respectively provided with the second contact bevels 41*b*. The first contact bevels 51*a* and the second contact bevels 41*b* are in pairs and attached to each other closely.

The working process of the invention is as follows:

When the hand wheel 3 stops rotating, the pillow like body 51 and the meshing block 4 are in the balanced state, and the two springs 52 are compressed to the same degree. At this time, the front end of the meshing block 4 is separated from the inner toothed ring 22.

When the hand wheel 3 starts rotating towards one direction, the pillow like body 51 and the meshing block 4 are not balanced any more. Under the action of the springs 52, the pillow like body 51 gradually inclines with its one side as the pivot point, and consequently driving the meshing block 4 incline also with this side as the pivot point, finally realizing rotation. At this time, the front end of the meshing block 4 can mesh with the inner toothed ring 22. After the front end of the meshing block 4 has meshed with the inner toothed ring 22, the hand wheel 3 can drive the dismantling head 2 rotate. Due to the first contact bevel 51*a* and second contact bevel 41*b*, the pillow like body 51 and the tile like part 41 are coordinated more closely and stably, not causing slippage. Since the third inclined planes 51*b* can produce inclined and inward acting force against the springs 52, the springs 52 will not slip from the tile like part 41. When the hand wheel is rotating reversely, the pillow like body 51 gradually inclines with its other side as the pivot point, and consequently driving the meshing block 4 incline also with this side as the pivot point finally realizing rotation. At this time, the front end of the meshing block 4 also can be meshed with the inner toothed ring 22. Its working process is same with that of the forward rotation.

Apparently, in this application, the rotation direction and the pivot point of rotation of the pillow like body 51 and meshing block 4 can change depending on the rotation direction of the hand wheel 3.

The mode of carrying out the invention herein only explains this invention by examples. Technical personnel in the technical field of this invention can make modifications or supplements of all sorts on or adopt similar way to substitute this mode of carrying out the invention, but not deviate from spirit of this invention or exceed the scope defined in Claims.

Although terms, such as body 1, widow 11, compression spring hole 12, convex bar 13, spring hole 14, dismantling head 2, dismantling structure 21, inner toothed ring 22, hand wheel 3, holding hole 31, notch 32, meshing block 4, tile like part 41, convex block 41*a*, second contact bevel 41*b*, meshing part 42, pillow like body 51, first contact bevel 51*a*, third inclined plane 51*b*, spring 52, compression spring 61, steel ball 62, bolt 7, are used frequently, herein, it does not exclude the possibility of using other terms. The use of these terms is only for describing and explaining the nature of this invention more conveniently; it is against the spirit of this invention to explain these terms into any kind of additional limit.

The invention claimed is:

1. A dismantling device, comprising a tubular body and a tubular dismantling head, with the front end of the body inserted into the back end of the dismantling head, and the front end of the dismantling head provided with a dismantling structure to be engaged with work piece, wherein: the inner wall of the back end of the said dismantling head is provided with an inner toothed ring encircled by a number of teeth, the outside of the said body is encircled by a hand wheel, the hand wheel is provided with a meshing block, revolving together with the hand wheel by the drive of hand wheel, a window is at the side of the body, a link mechanism is provided inside the window, driving the meshing block rotate for a certain angle and making the front end of the meshing block engage with the inner toothed ring at the dismantling head when the hand wheel is rotating, and the said dismantling head can rotate synchronously with the hand wheel when the meshing block is engaged with the inner toothed ring and keeps rotating the hand wheel.

2. The dismantling device according to claim 1, wherein the said link mechanism includes a pillow like body and two springs, wherein the said pillow like body is inside the window and two sides thereof respectively bear down upon the two sides of the meshing block, the said two springs are respectively at the two sides of the pillow like body, and one end of any of the springs is connected to the body and the other end of any of the springs is connected to the end part of the pillow like body.

3. The dismantling device according to claim 2, wherein the said meshing block is provided with a tile like part, on the outside face of the window, and a meshing part, extending forwards to the interior of the dismantling head, wherein the said tile like part pumps up outwards, the outside face of the tile like part is provided with a convex block, and the inner wall of the hand wheel is provided with a holding hole for holding the said convex block.

4. The dismantling device according to claim 3, wherein the said pillow like body is depressed in the middle part and the two sides on the outside face thereof respectively are provided with first contact bevels, wherein the two sides on the inside face of the said tile like part are respectively provided with the second contact bevels, the said first contact bevels and the second contact bevels are in pairs and attached to each other closely.

5. The dismantling device according to claim 4, wherein the two sides of the inside face of the said tile like part are respectively provided with the third inclined planes inclining inwards, and the said two springs respectively act upon both of the third inclined planes.

6. The dismantling device according to claim 4, wherein the said body has two spring holes, one of the said springs is fitted into one spring hole.

7. The dismantling device according to claim 1, wherein a positioning structure is provided between the said body and hand wheel, including a compression spring and a steel ball, the said compression spring is in the compression spring hole on the outer wall of the body, the inner wall of the said hand wheel has a notch, and the said compression spring presses the steel ball inside the notch.

8. The dismantling device according to claim 7, wherein the said body is fixed to the dismantling head through bolt.

9. The dismantling device according to claim 7, wherein the outside face of the said hand wheel is provided with a concave-convex friction increasing structure.

10. The dismantling device according to claim 7, wherein the outside face of the back end of said body is provided with a number of convex bars extending axially.

* * * * *